US010665949B2

(12) United States Patent
Ozaki et al.

(10) Patent No.: US 10,665,949 B2
(45) Date of Patent: May 26, 2020

(54) LIGHTING-UP DEVICE AND LUMINAIRE

(71) Applicant: PANASONIC INTELLECTUAL PROPERTY MANAGEMENT CO., LTD., Osaka (JP)

(72) Inventors: Hajime Ozaki, Kyoto (JP); Tatsumi Setomoto, Osaka (JP); Tamotsu Ando, Osaka (JP); Koji Matsushita, Osaka (JP); Tomokazu Yamamoto, Osaka (JP); Kohji Hiramatsu, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 191 days.

(21) Appl. No.: 15/900,642

(22) Filed: Feb. 20, 2018

(65) Prior Publication Data

US 2018/0242436 A1 Aug. 23, 2018

(30) Foreign Application Priority Data

Feb. 22, 2017 (JP) ..... 2017-031473

(51) Int. Cl.
*H01Q 13/10* (2006.01)
*H01Q 1/36* (2006.01)
(Continued)

(52) U.S. Cl.
CPC ..... *H01Q 13/10* (2013.01); *H01Q 1/36* (2013.01); *H01Q 9/42* (2013.01); *F21S 8/026* (2013.01);
(Continued)

(58) Field of Classification Search
CPC .... F21V 23/0435; H05B 37/0272; H01Q 1/22
See application file for complete search history.

(56) References Cited

U.S. PATENT DOCUMENTS

2004/0137971 A1 7/2004 Shoji
2012/0268343 A1* 10/2012 Yanagi ..... H01Q 1/526 343/872
(Continued)

FOREIGN PATENT DOCUMENTS

JP 10-145126 A 5/1998
JP 2004-159029 A 6/2004
(Continued)

*Primary Examiner* — Daniel Munoz
(74) *Attorney, Agent, or Firm* — McDermott Will & Emery LLP

(57) ABSTRACT

A lighting-up device includes: a power supply circuit which supplies power to a light source; a wireless communication circuit including an antenna; and a metallic casing which includes metal, and houses the power supply circuit and the wireless communication circuit. The metallic casing has a first side face and a second side face which share a side, the first side face is provided with a first slit which extends in a first direction intersecting with the side, from a first portion of the side other than both ends of the side, the second side face is provided with a second slit which extends in a second direction intersecting with the side, from a second portion of the side other than the both ends of the side, and each of the first slit and the second slit is electromagnetically coupled to the antenna and functions as a slot antenna.

20 Claims, 11 Drawing Sheets

(51) Int. Cl.

| | |
|---|---|
| ***H01Q 9/42*** | (2006.01) |
| *F21S 8/02* | (2006.01) |
| *F21V 15/01* | (2006.01) |
| *F21V 23/00* | (2015.01) |
| *F21V 23/04* | (2006.01) |
| *F21V 21/04* | (2006.01) |
| *F21V 23/02* | (2006.01) |
| *H05B 47/19* | (2020.01) |

(52) U.S. Cl.
CPC ..... *F21V 15/01* (2013.01); *F21V 21/047* (2013.01); *F21V 23/001* (2013.01); *F21V 23/023* (2013.01); *F21V 23/045* (2013.01); *H05B 47/19* (2020.01)

(56) References Cited

U.S. PATENT DOCUMENTS

| | | | | |
|---|---|---|---|---|
| 2012/0274208 | A1* | 11/2012 | Chen ..... | H01Q 1/38 315/34 |
| 2013/0181607 | A1 | 7/2013 | Yotsumoto et al. | |
| 2016/0069551 | A1 | 3/2016 | Ando et al. | |
| 2016/0072176 | A1* | 3/2016 | Van Dijk ..... | H01Q 1/44 343/721 |
| 2016/0262245 | A1 | 9/2016 | Ando | |

FOREIGN PATENT DOCUMENTS

| | | | |
|---|---|---|---|
| JP | 2013-033652 | A | 2/2013 |
| JP | 2013-145634 | A | 7/2013 |
| JP | 2016-058167 | A | 4/2016 |
| JP | 2016-162726 | A | 9/2016 |

* cited by examiner

LIGHTING-UP DEVICE AND LUMINAIRE

CROSS REFERENCE TO RELATED APPLICATION

This application claims the benefit of priority of Japanese Patent Application Number 2017-031473 filed on Feb. 22, 2017, the entire content of which is hereby incorporated by reference.

BACKGROUND

1. Technical Field

The present disclosure relates to a lighting-up device and a luminaire which includes the lighting-up device.

2. Description of the Related Art

Lighting apparatuses having wireless communication functions are conventionally known. For example, Japanese Unexamined Patent Application Publication No. 2013-145634 discloses a lighting apparatus which includes an antenna for wireless communications and performs processing according to a radio signal received by the antenna.

SUMMARY

It is desirable that an antenna included in a lighting apparatus is unnoticeable in a state in which the lighting apparatus is installed, from the perspective of design and a light distribution property. For that reason, an antenna is, for example, disposed inside a casing which houses a power supply circuit that supplies power to the lighting apparatus.

However, the casing which houses the power supply circuit is formed generally using metal, from the perspective of safety. A metallic casing shields against radio waves, and thus poses a problem of ensuring a communication function of an antenna.

In view of the above, an object of the present disclosure is to provide a lighting-up device which excels in communication performance in wireless communications, and a luminaire which includes the lighting-up device.

In order to achieve the above-described object, a lighting-up device according to an aspect of the present disclosure includes: a power supply circuit which supplies power to a light source; a wireless communication circuit including an antenna that receives a control signal for controlling an operation of the power supply circuit; and a metallic casing which includes metal, and houses the power supply circuit and the wireless communication circuit, wherein the metallic casing has a first side face and a second side face which share a first side, the first side face is provided with a first slit which extends in a first direction intersecting with the first side, from a first portion of the first side other than both ends of the first side, the second side face is provided with a second slit which extends in a second direction intersecting with the first side, from a second portion of the first side other than the both ends of the first side, and each of the first slit and the second slit is electromagnetically coupled to the antenna and functions as a slot antenna.

In addition, a luminaire according to an aspect of the present disclosure includes the lighting-up device and the light source.

According to the present disclosure, it is possible to provide a lighting-up device and the like which excel in communication performance in wireless communications.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following describes in detail a lighting-up device and a luminaire according to embodiments of the present disclosure, with reference to the drawings. It should be noted that the embodiments described below each indicate one specific example of the present disclosure. The numerical values, shapes, materials, structural components, the disposition and connection of the structural components, etc. described in the following embodiments are mere examples, and do not intend to limit the present disclosure. Furthermore, among the structural components in the following exemplary embodiments, components not recited in the independent claim which indicates the broadest concept of the present disclosure are described as arbitrary structural components.

In addition, each diagram is a schematic diagram and not necessarily strictly illustrated. Accordingly, for example, scale sizes, etc., are not necessarily exactly represented. In each of the diagrams, substantially the same structural components are assigned with the same reference signs, and redundant descriptions will be omitted or simplified.

Furthermore, axis X, axis Y, and axis Z represent three axes of a three-dimensional orthogonal coordinate system in the Description and Drawings of the present application. In each of the embodiments, the direction of axis Z is a vertical direction, and the direction perpendicular to axis Z (i.e., the direction parallel to an XY plane) is a horizontal direction. In addition, the positive direction of the axis Z is a vertically upward direction.

Embodiment (Overview)

Figure 1:
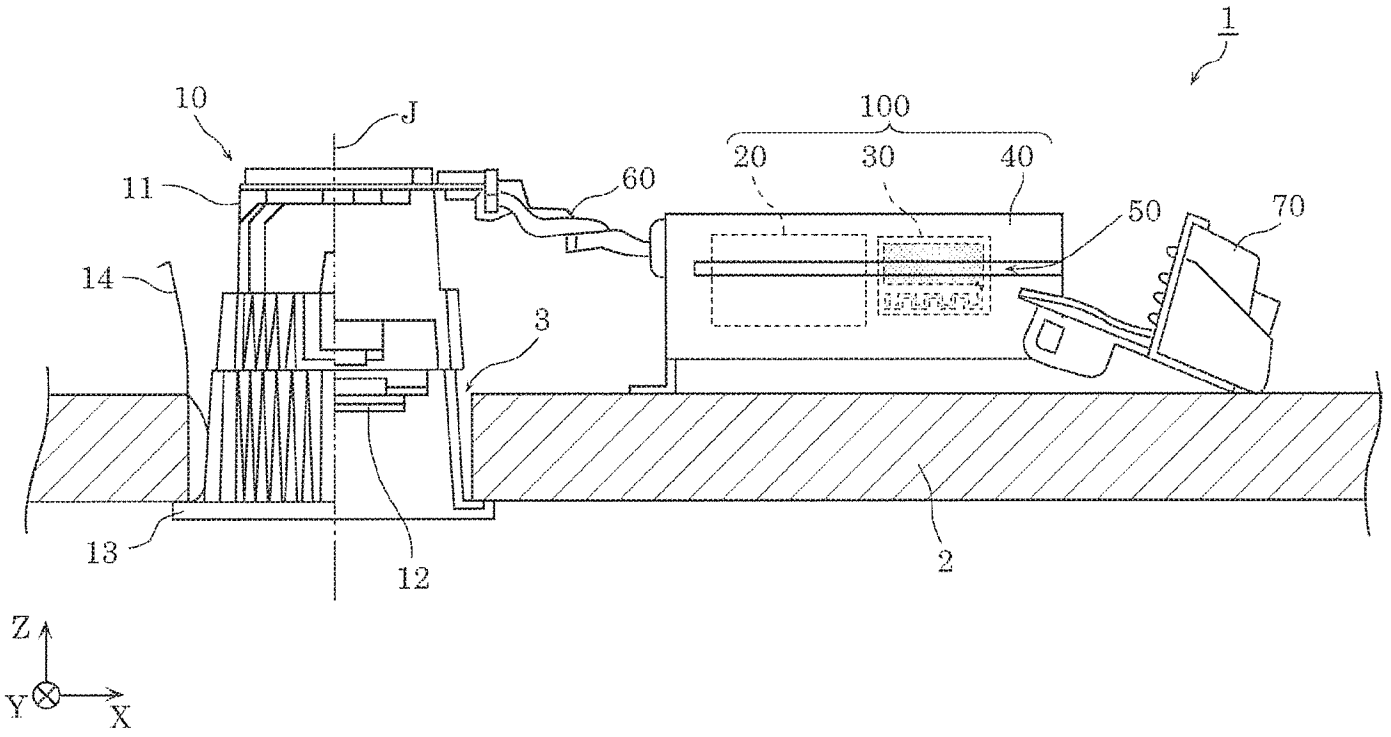
FIG. 1 is a side face view which schematically illustrates a configuration of a luminaire according to the embodiment.

First, an overview of a luminaire according to the present embodiment will be described with reference to FIG. 1. FIG. 1 is a side face view which schematically illustrates a configuration of luminaire 1 according to the present embodiment.

As illustrated in FIG. 1, luminaire 1 is a recessed lighting apparatus which is installed by being recessed in attachment hole 3 included in ceiling member 2. Luminaire 1 is a ceiling recessed downlight which emits light downward (i.e., to a floor or a wall, for example).

As illustrated in FIG. 1, luminaire 1 includes lamp 10 and lighting-up device 100 which supplies power to light source 12 included in lamp 10. Lighting-up device 100 includes power supply circuit 20, wireless communication circuit 30, and metallic casing 40 made of metal. Metallic casing 40 is provided with slit 50. Luminaire 1 further includes cable 60 which connects lamp 10 and lighting-up device 100, and terminal base 70 which receives AC power from an external power supply such as a commercial power supply.

The following describes in detail each structural component included in luminaire 1 according to the present embodiment.

(Lamp)

Lamp 10 is a main body of luminaire 1, and emits illuminating light such as white light. As illustrated in FIG. 1, lamp 10 includes lamp body 11, light source 12, flange 13, and attachment spring 14. It should be noted that, in FIG. 1, with respect to light axis J of lamp 10 as a boundary, an external appearance (side surface) of lamp 10 is schematically illustrated on the left side, and an internal configuration of lamp 10 is schematically illustrated on the right side.

Lamp body 11 is, for example, a closed-end tubular body having a shape of a substantially circular truncated cone, and light source 12 is attached to an attachment surface of an inside of lamp body 11. A plurality of cooling fins which protrude outwardly are disposed on the outer circumference surface of a bottom portion of lamp body 11. Lamp body 11 is, for example, formed using a metal material. For example, lamp body 11 is an aluminum die-cast lamp body.

Attachment spring 14 is fixed to the outer circumference surface of lamp body 11. Attachment spring 14 is a thin plate component having an elongate shape, and is shaped by press working or the like using a metal material such as iron. Attachment spring 14 and flange 13 clamp ceiling member 2, thereby fixing 10 to attachment hole 3. Flange 13 is an end portion of lamp body 11 on a light exit side, and is formed into a substantially annular shape to enclose a light exit port.

Light source 12 is a light source module including a light emitting element such as a light emitting diode (LED). Light source 12 emits visible light such as white light as illumination light. Light source 12 is capable of, for example, dimming and toning according to control performed by power supply circuit 20.

Light source 12 is, for example, a chip on board (COB) light source module. However, light source 12 is not limited to this example. Light source 12 may be a light source module which includes a surface mount device (SMD) LED. Alternatively, light source 12 may include an organic electro luminescence (EL) element or an inorganic EL element, or may include a discharge lamp such as a fluorescent lamp.

(Power Supply Circuit)

Power supply circuit 20 is a lighting circuit which supplies power to light source 12 of lamp 10. Power supply circuit 20 is disposed inside metallic casing 40. Power supply circuit 20 includes a circuit board, such as a printed circuit board, on which a metal line is formed, and a plurality of circuit elements mounted on the circuit board. Power supply circuit 20 converts AC power received from outside via terminal base 70 to DC power, and supplies the converted DC power to light source 12 of lamp 10. According to the present embodiment, power supply circuit 20 supplies power to light source 12 of lamp 10 via cable 60.

(Wireless Communication Circuit)

Wireless communication circuit 30 receives a control signal for controlling an operation of power supply circuit 20, by performing a wireless communication. Wireless communication circuit 30 performs a wireless communication based on a wireless communication standard such as Wi-Fi (registered trademark), Bluetooth (registered trademark), ZigBee (registered trademark), etc. For example, wireless communication circuit 30 performs a wireless communication using a frequency of ultra high frequency (UHF) band ranging from 300 MHz to 3 GHz. Wireless communication circuit 30 receives a control signal from, for example, a control device or other luminaire 1 having a wireless communication function. The control signal includes an instruction such as turning on, turning off, dimming, toning, etc. of light source 12.

According to the present embodiment, wireless communication circuit 30 is housed inside metallic casing 40. More specifically, wireless communication circuit 30 is disposed in proximity to slit 50 inside metallic casing 40.

Figure 2:
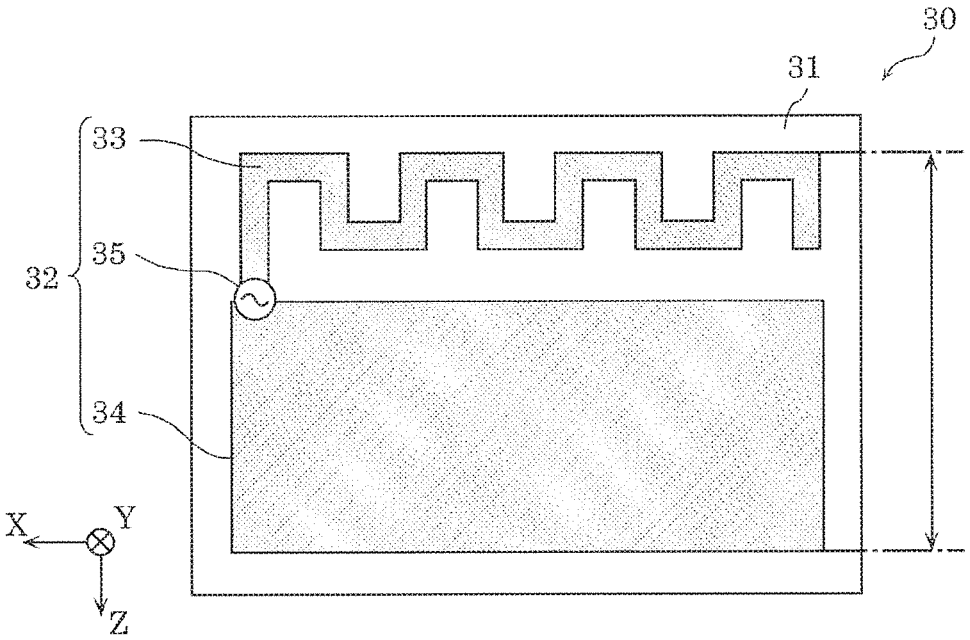
FIG. 2 is a plan view of a wireless communication circuit which a lighting-up device according to the embodiment includes.

FIG. 2 is a plan view of wireless communication circuit 30 which lighting-up device 100 according to the present embodiment includes. As illustrated in FIG. 2, wireless communication circuit 30 includes board 31 and antenna 32 which receives a control signal. Wireless communication circuit 30 controls power supply circuit 20 based on the control signal received by antenna 32.

Antenna 32 is an antenna for primary excitation, and causes slit 50 provided in metallic casing 40 to function as a secondary antenna. Antenna 32 is, for example, a pattern antenna disposed on board 31. However, antenna 32 is not limited to this example. Board 31 is a printed circuit board, for example. Board 31 may be integrally formed with a circuit board of power supply circuit 20.

As illustrated in FIG. 2, antenna 32 includes radiation conductor 33, grounded conductor 34, and feeding point 35. It should be noted that feeding point 35 is schematically illustrated in FIG. 2.

Radiation conductor 33 is a metal line made of copper, for example, and is formed to have a length corresponding to a frequency (an electromagnetic wave length) of wireless communications. For example, when the wavelength of a radio signal is A, the length of radiation conductor 33 is approximately λ/4. In the example here, radiation conductor 33 is disposed to have a meander shape. However, radiation conductor 33 may be disposed to have a linear shape, an L shape, a spiral shape, or a rectangular planer shape.

Grounded conductor 34 is a part of the metal line made of copper, for example, and is grounded. Grounded conductor 34 virtually exerts a function equivalent to a function of radiation conductor 33. The shape of grounded conductor 34 is rectangle, for example. However, the shape of grounded conductor 34 is not limited to this example.

Although not illustrated, wireless communication circuit 30 includes a control circuit such as an IC chip, which is disposed on board 31 and processes a control signal received by antenna 32. For example, the IC chip may be mounted on a surface of board 31 on which antenna 32 is formed, or may be mounted on the opposite surface. The IC chip is electrically connected to feeding point 35 of antenna 32, for example.

(Metallic Casing and Slit)

Metallic casing 40 is a metal casing which houses power supply circuit 20 and wireless communication circuit 30. Metallic casing 40 prevents dust and moisture from attaching to power supply circuit 20 and wireless communication circuit 30. Metallic casing 40 is formed using, for example, a metal material such as aluminum, for the purpose of preventing occurrence of fire or the like in such a case where a circuit such as power supply circuit 20 short-circuits.

Metallic casing 40 is, for example, an elongated metallic casing having a substantially cuboid shape. Cable 60 is connected to one end of metallic casing 40 in the longitudinal direction (the direction of axis X). Terminal base 70 for receiving AC power from outside (i.e., from a commercial power supply) is connected to the other end of metallic casing 40. It should be noted that the shape of metallic casing 40 may be substantially cubic or substantially cylindrical.

Figure 3:
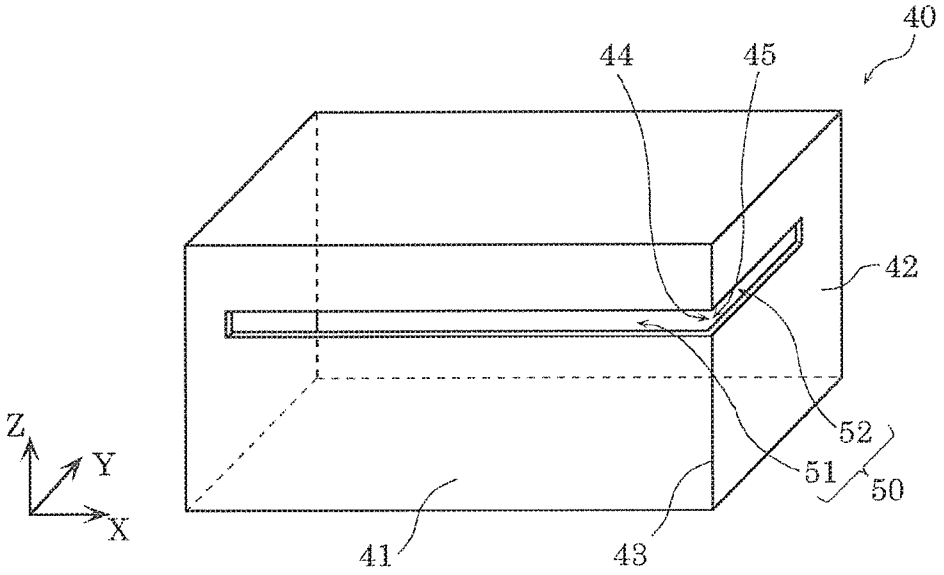
FIG. 3 is a perspective view of a power supply metallic casing including a slit having an L shape, according to an working example of the embodiment.

According to the present embodiment, at least one slit 50 is included in an outer surface of metallic casing 40 as illustrated in FIG. 1. The following describes in detail metallic casing 40 and slit 50 with reference to FIG. 3. FIG. 3 is a perspective view of metallic casing 40 including slit 50 having an L shape, according to the present embodiment.

As illustrated in FIG. 3, metallic casing 40 includes side face 41 and side face 42 which share side (an edge line) 43. Side face 41 and side face 42 are connected by side 43 to form a predetermined angle. For example, side face 41 and side face 42 are substantially vertically connected. Side face 41 is a first side face extending along a longitudinal direction of metallic casing 40, and side face 42 is a second side face extending along a crosswise direction of metallic casing 40. It should be noted that one of side face 41 and side face 42 may be a top face or a bottom face of metallic casing 40.

Side face 41 is provided with first slit 51 which extends in the first direction intersecting with side 43, from first portion 44 that is a portion of side 43 other than both ends of side 43. According to the present embodiment, the first direction in which first slit 51 extends is orthogonal to side 43. In other words, the first direction is a longitudinal direction of metallic casing 40 (i.e., the direction of axis X). First slit 51 is an elongated opening (through hole) having a substantially rectangular shape. First slit 51 does not coincide with an end of side face 41 (i.e., an edge line of metallic casing 40). Side face 41 is present on both sides of first slit 51 in the crosswise direction.

Side face 42 is provided with second slit 52 which extends in the second direction intersecting with side 43, from second portion 45 that is a portion of side 43 other than both ends of side 43. According to the present embodiment, the second direction in which second slit 52 extends is orthogonal to side 43. In other words, the second direction is a crosswise direction of metallic casing 40 (i.e., the direction of axis Y). Second slit 52 is an elongated opening (through hole) having a substantially rectangular shape. Second slit 52 does not coincide with an end of side face 42 (i.e., an edge line of metallic casing 40). Side face 42 is present on both sides of second slit 52 in the crosswise direction.

According to the present embodiment, as illustrated in FIG. 3, first portion 44 and second portion 45 are a same portion of side 43. Accordingly, first slit 51 is continuous with second slit 52 at first portion 44 (i.e., at second portion 45). More specifically, first slit 51 and second slit 52 are orthogonal to each other, and form slit 50 having an L shape in a top view.

Slit 50 is electromagnetically coupled to antenna 32 of wireless communication circuit 30 to function as a slot antenna. For example, when a radio signal (electromagnetic wave) transmitted from outside is received, an electric field is generated in the short side direction of slit 50 (i.e., the direction of axis Z) due to the radio signal. In this manner, slit 50 functions as an antenna, and emits the received radio signal to antenna 32 disposed inside metallic casing 40. Likewise, when antenna 32 transmits a radio signal (electromagnetic wave), an electric field is generated in the short side direction of slit 50 due to the radio signal. In this manner, slit 50 functions as an antenna, and emits the radio signal to the outside.

It should be noted that, in order to cause slit 50 to function as a slot antenna, antenna 32 is disposed at a position close to slit 50 in metallic casing 40. For example, wireless communication circuit 30 is disposed in proximity to side face 41 such that a main face of board 31 (a face on which antenna 32 is disposed) is parallel to side face 41. At this time, in a plan view of antenna 32, antenna 32 is disposed such that slit 50 overlaps with a range indicated by a double-headed arrow illustrated in FIG. 2. Slit 50 is disposed so as to be orthogonal to an excitation direction of antenna 32 (i.e., the direction of axis Z). For example, slit 50 overlaps grounded conductor 34 of antenna 32, and extends parallel to the axis X.

The length of slit 50 along the extending direction; that is, a total length of the length of first slit 51 (in the direction of axis X) and the length of second slit 52 (in the direction of axis Y) is, for example, at least an approximately half of wavelength λ (i.e., λ/2) that corresponds to a frequency of the wireless communication. Since a frequency of the UHF band is used according to the present embodiment, the length of slit 50 in the extending direction is in a range from 50 mm to 500 mm. For example, when a frequency of 960 MHz is used for the wireless communication, slit 50 needs to have a length of approximately 160 mm.

It should be noted that, according to the present embodiment, the length of metallic casing 40 in the longitudinal direction is less than the total length of slit 50 that is specifically λ/2 of a radio signal). In other words, it is not possible to provide linearly a slit which has a length of λ/2 on one side face (for example, side face 41) of metallic casing 40. For that reason, slit 50 is provided to extend over two faces according to the present embodiment.

(Cable and Terminal Base)

Cable 60 connects lamp 10 and metallic casing 40. More specifically, cable 60 is fixed to each of lamp 10 and metallic casing 40. Cable 60 is an interconnecting cable for power supply. For that reason, cable 60 is electrically connected to power supply circuit 20 housed in metallic casing 40, and to light source 12 of lamp 10.

Terminal base 70 is a power receiver which receives AC power from an external power supply such as a commercial power supply. An AC cable (not illustrated) connected to the commercial power supply or the like is connected to terminal base 70. The AC power received by terminal base 70 is converted to DC power by power supply circuit 20, and supplied to light source 12 via cable 60.

(Wireless Communication Performance)

Next, a simulation result of a wireless communication performance of luminaire 1 (lighting-up device 100) according to the present embodiment will be described, with reference to a comparison example.

The following describes, as a working example, the case where slit 50 has a length of approximately 154 mm in metallic casing 40 illustrated in FIG. 3. In addition, first slit 51 of slit 50 is provided so as to overlap with grounded conductor 34 of antenna 32 in a plan view of side face 41.

In addition, as comparison example 1 and comparison example 2, the cases where slit 50 provided in metallic casing 40 has a shape different from the shape of slit 50 in the working example will be described.

Figure 4A:
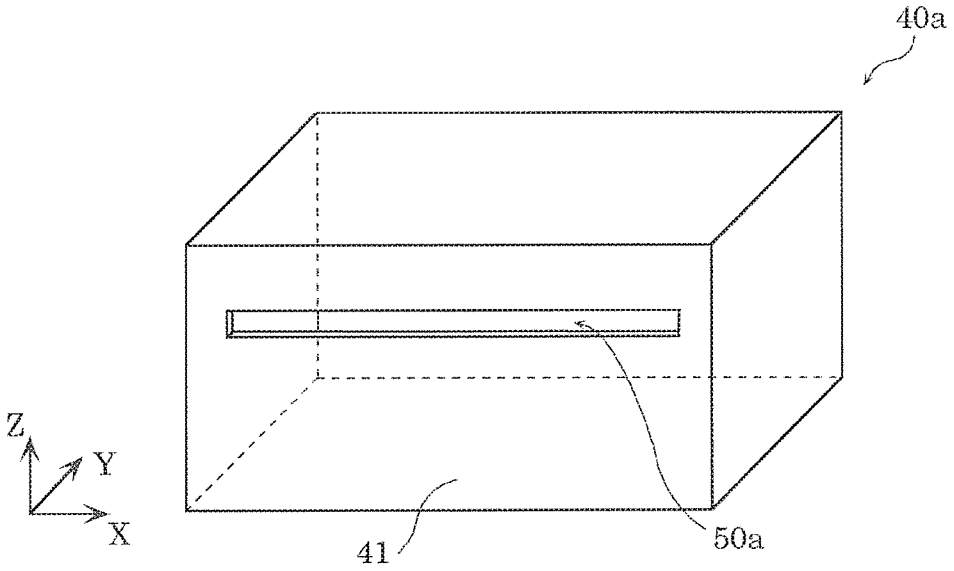
FIG. 4A is a perspective view of a power supply metallic casing including a single slit, according to comparison example 1.
Figure 4B:
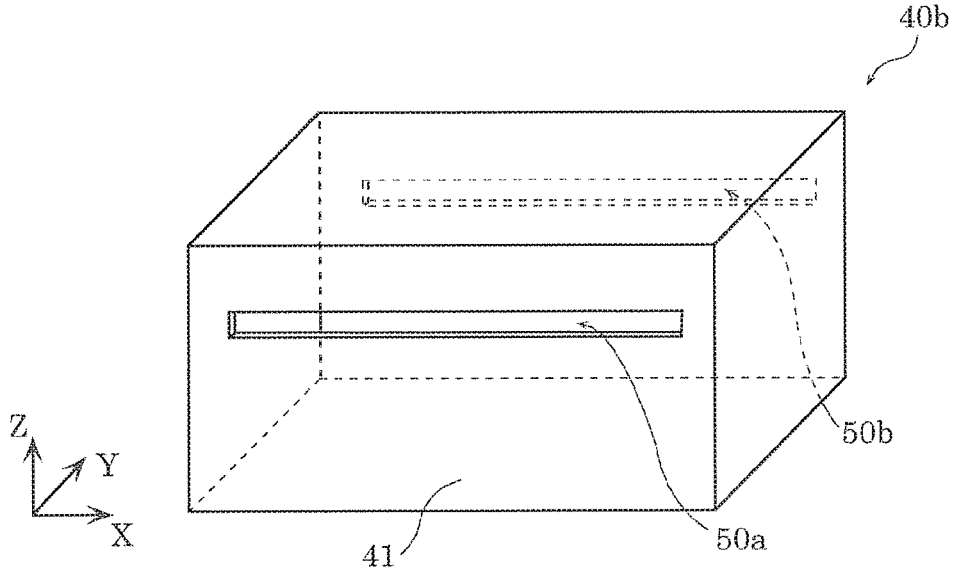
FIG. 4B is a perspective view of a power supply metallic casing including two slits, according to comparison example 2.

FIG. 4A and FIG. 4B are perspective views of metallic casing 40*a* according to comparison example 1 and metallic casing 40*b* according to comparison example 2, respectively. As illustrated in FIG. 4A, metallic casing 40*a* according to comparison example 1 is provided with a single elongated slit 50*a* which extends in the direction of axis X and has a substantially rectangular shape, on side face 41. In addition, as illustrated in FIG. 4B, metallic casing 40*b* according to comparison example 2 is provided with not only slit 50*a* in the same manner as comparison example 1 but also slit 50*b* on a side face opposite to side face 41. Slit 50*a* and slit 50*b* have the same length of approximately 125 mm. Slit 50*a* and slit 50*b* are provided so as to overlap with each other in proximity to feeding point 35 of antenna 32. It should be noted that slit 50, slit 50*a*, and slit 50*b* are identical in a slit width (the length in a crosswise direction). For example, the slit width is less than or equal to 1 mm, and may be 0.5 mm or 0.1 mm.

Figure 5A:
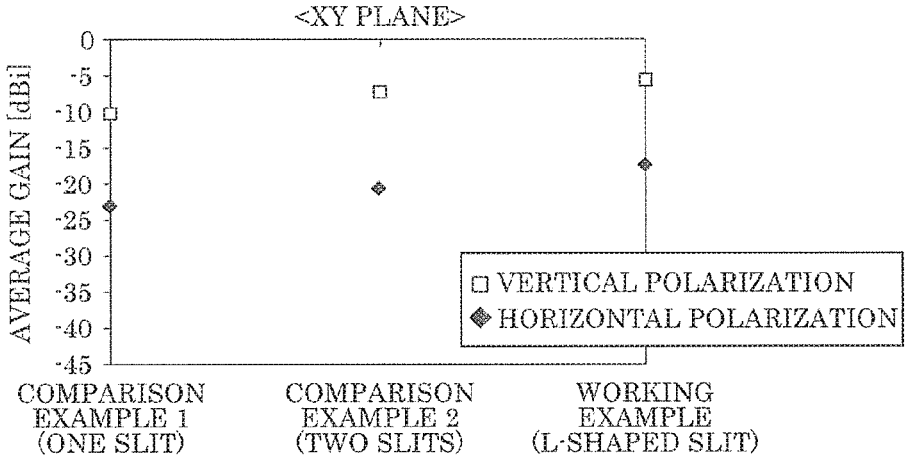
FIG. 5A is a diagram which indicates average gains in an XY plane according to the working example, comparison example 1, and comparison example 2.
Figure 5B:
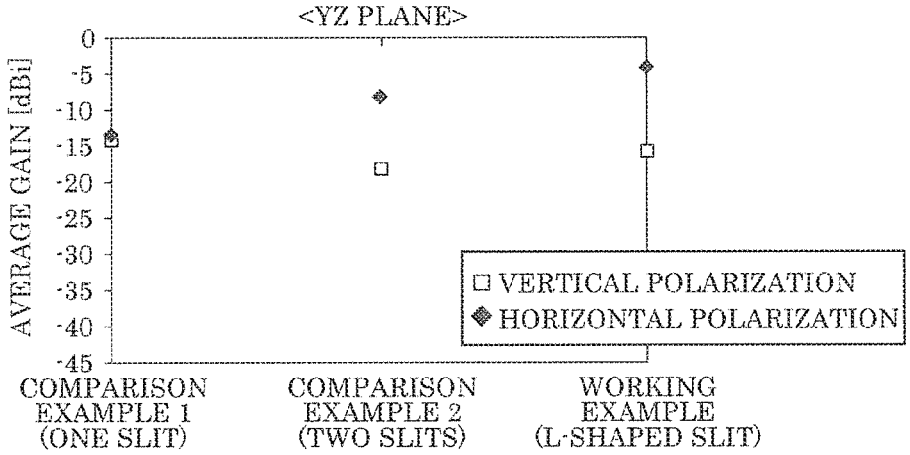
FIG. 5B is a diagram which indicates average gains in a YZ plane according to the working example, comparison example 1, and comparison example 2.
Figure 5C:
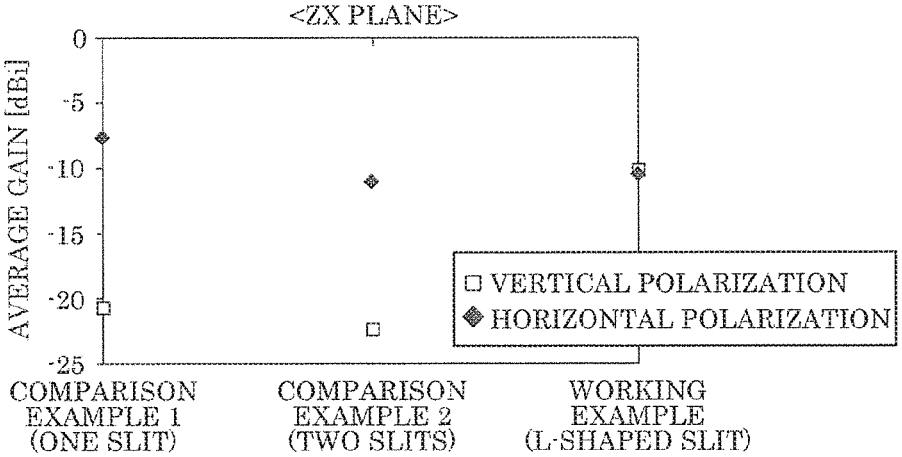
FIG. 5C is a diagram which indicates average gains in a ZX plane according to the working example, comparison example 1, and comparison example 2.

FIG. 5A to FIG. 5C are diagrams which indicate average gains according to a working example, comparison example 1, and comparison example 2, in an XY plane, a YZ plane, and a ZX plane, respectively. It should be noted that, although FIG. 5A to FIG. 5C indicate average gains of both of vertical polarization and horizontal polarization, the vertical polarization is used in a wireless communication according to the present embodiment, since the horizontal polarization has directivity.

The XY plane is a plane which is orthogonal to the main face (the face on which antenna 32 is disposed) of board 31 of wireless communication circuit 30, and parallel to slits 50, 50*a*, and 50*b*. More specifically, the XY plane is a plane parallel to ceiling member 2. The YZ plane is a plane which is orthogonal to the main face of board 31, and orthogonal to first slit 51 of slit 50, and to slits 50*a* and 50*b*. The ZX plane is a plane which is parallel to the main face of board 31, and orthogonal to second slit 52 of slit 50 and slits 50*a* and 50*b*.

As illustrated in FIG. 5A, the average gain of the vertical polarization in the case of metallic casing 40 according to the working example is greater than the average gains according to comparison examples 1 and 2. It should be noted that the same holds true for the horizontal polarization.

As illustrated in FIG. 5B, in the YZ plane, the average gain of the vertical polarization in the case of metallic casing 40 according to the working example is substantially the same as metallic casing 40*a* according to comparison example 1, and is greater than metallic casing 40*b* according to comparison example 2. It should be noted that the average gain of the horizontal polarization is greater in the working example than in comparison example 1 and comparison example 2.

As illustrated in FIG. 5C, in the ZX plane, the average gain of the vertical polarization in the case of metallic casing 40 according to the working example is significantly greater than the average gains according to comparison example 1 and comparison example 2. It should be noted that the average gain of the horizontal polarization is less in the working example than in comparison example 1 and comparison example 2.

As described above, when a wireless communication is carried out using the vertical polarization, the average gain is increased by using metallic casing 40 according to the working example, compared to comparison examples 1 and 2. In particular, the average gain in the ZX plane is significantly increased.

Figure 6A:
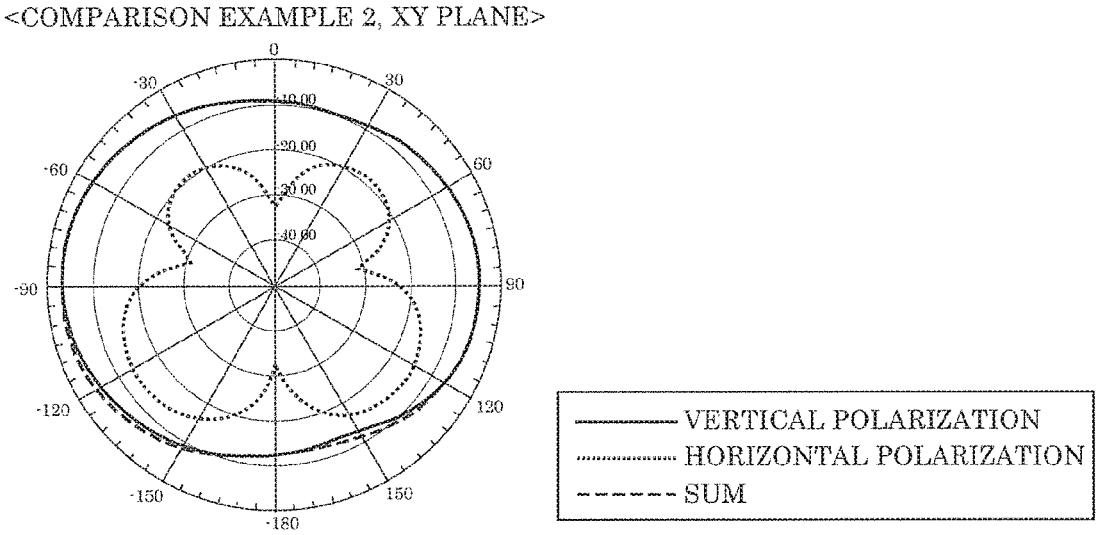
FIG. 6A is a diagram which indicates antenna characteristics in the XY plane according to comparison example 2.
Figure 6B:
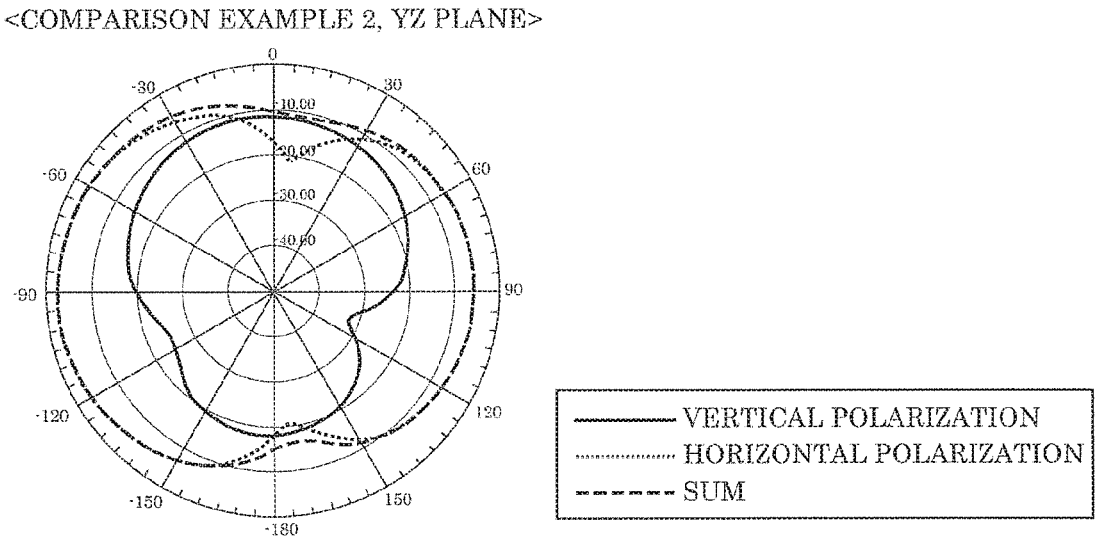
FIG. 6B is a diagram which indicates antenna characteristics in the YZ plane according to comparison example 2.
Figure 6C:
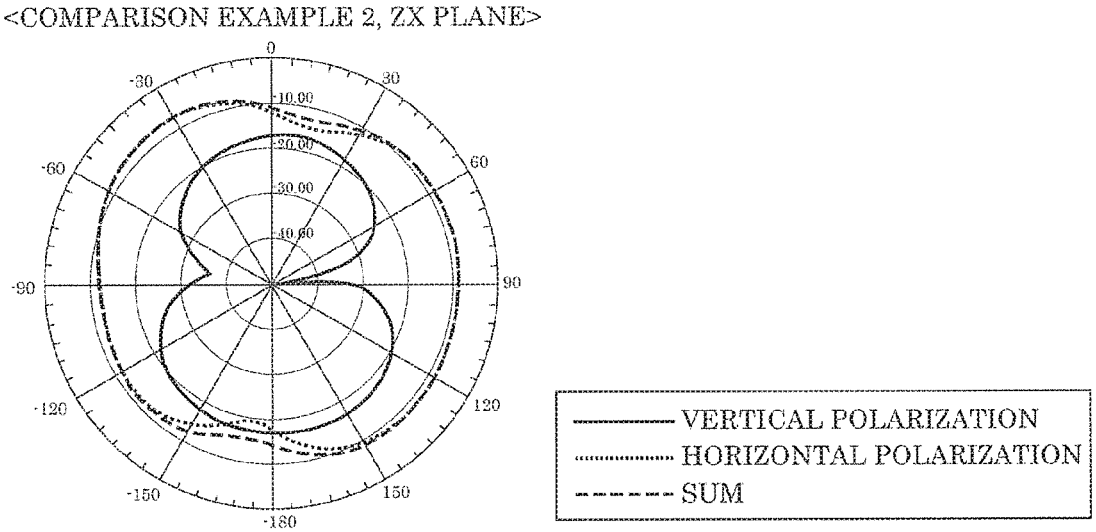
FIG. 6C is a diagram which indicates antenna characteristics in the ZX plane according to comparison example 2.
Figure 7A:
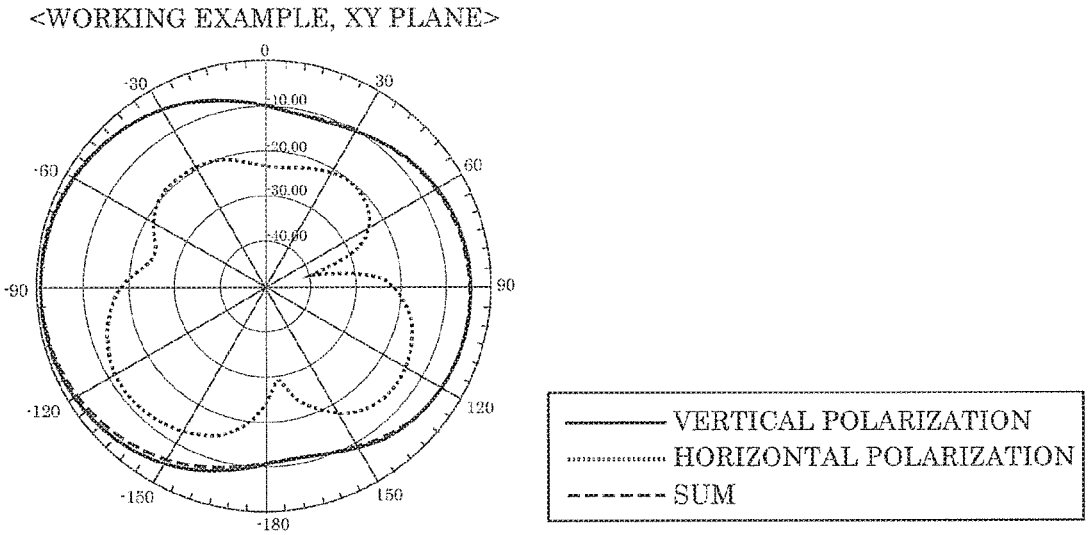
FIG. 7A is a diagram which indicates antenna characteristics in the XY plane according to the working example.
Figure 7B:
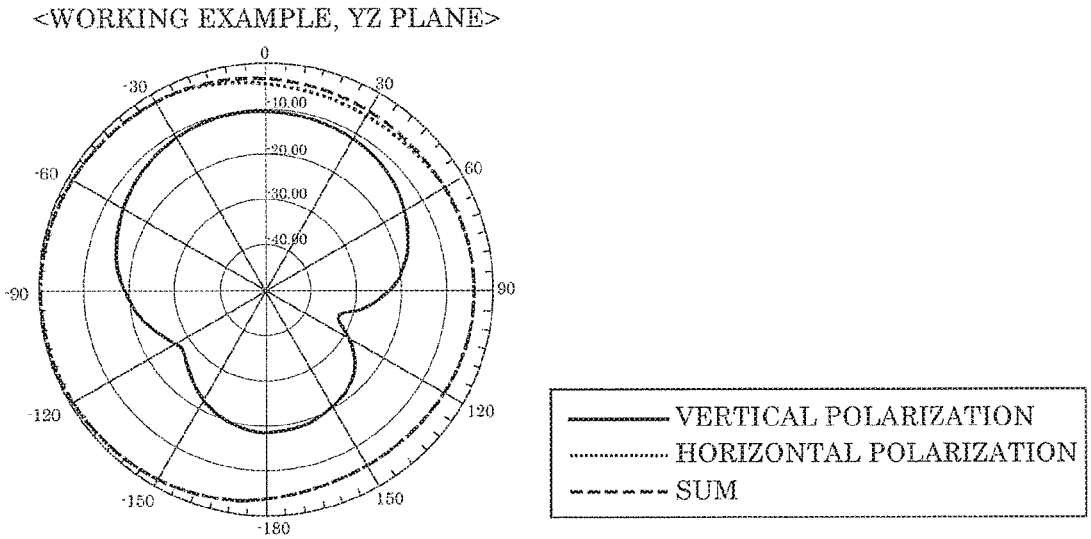
FIG. 7B is a diagram which indicates antenna characteristics in the YZ plane according to the working example.
Figure 7C:
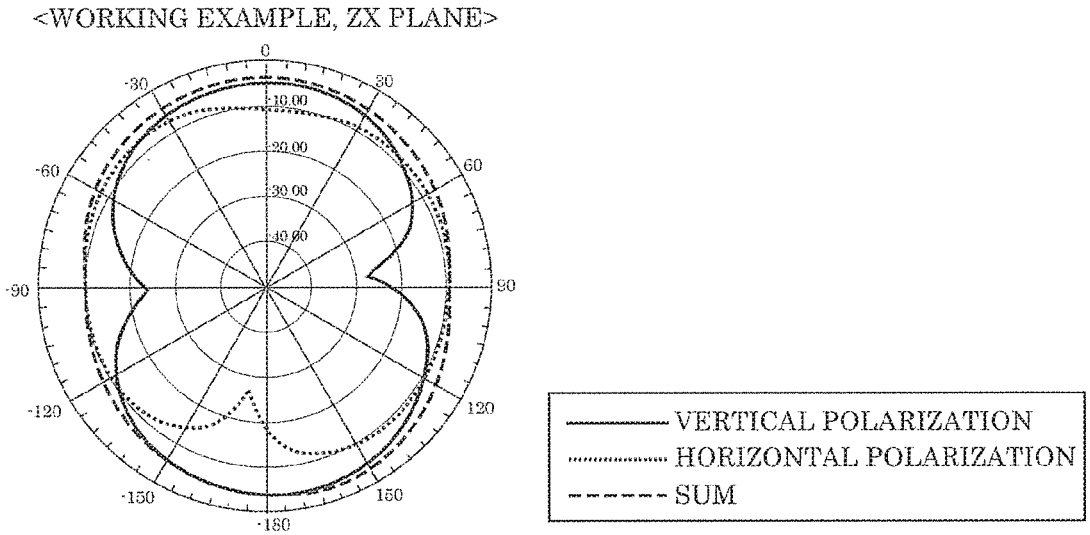
FIG. 7C is a diagram which indicates antenna characteristics in the ZX plane according to the working example.

FIG. 6A to FIG. 6C are diagrams which indicate antenna characteristics in an XY plane, a YZ plane, and a ZX plane, respectively, according to comparison example 2. FIG. 7A to FIG. 7C are diagrams which indicate antenna characteristics in an XY plane, a YZ plane, and a ZX plane, respectively, according to the working example. In each of the diagrams, a dotted line indicates horizontal polarization, a solid line indicates vertical polarization, and a dashed line indicates the sum of the horizontal polarization and the vertical polarization.

Comparison between FIG. 6A and FIG. 7A shows that, in each case of comparison example 2 and the working example, the gain of the vertical polarization in the XY plane is substantially equivalent in all directions, and thus the directivity is weak.

Comparison between FIG. 6B and FIG. 7B shows that, in each case of comparison example 2 and the working example, the gain of the vertical polarization in the XY plane is decreased in the direction of 115 degrees and −120 degrees. Accordingly, it shows that, in the working example, the characteristics equivalent to the characteristics of comparison example 2 is implemented.

Comparison between FIG. 6C and FIG. 7C shows that, in each case of comparison example 2 and the working example, the gain of the vertical polarization in the ZX plane is decreased in the direction of 90 degrees and −90 degrees. However, in the working example as illustrated in FIG. 7C, the decrease in the gain is suppressed, and the gain is increased as a whole. More specifically, as illustrated in FIG. 5C, the average gain in the working example significantly excels compared to the case in comparison example 2.

Advantageous Effects, Etc

As described above, lighting-up device 100 according to the present embodiment includes: power supply circuit 20 which supplies power to light source 12; wireless communication circuit 30 including antenna 32 that receives a control signal for controlling an operation of power supply circuit 20; and metallic casing 40 which includes metal, and houses power supply circuit 20 and wireless communication circuit 30. In lighting-up device 100 according to the present embodiment, metallic casing 40 has side face 41 and side face 42 which share side 43, side face 41 is provided with first slit 51 which extends in a first direction intersecting with side 43, from first portion 44 of side 43 other than both ends of side 43, side face 42 is provided with second slit 52 which extends in a second direction intersecting with side 43, from second portion 45 of side 43 other than the both ends of side 43, and each of first slit 51 and second slit 52 is electromagnetically coupled to antenna 32 and functions as a slot antenna.

According to this configuration, since a slit is included in two faces of metallic casing 40, the length of the slit is easily secured. For that reason, it is possible to enhance the communication performance of the wireless communication.

In particular, when a constructor installs luminaire 1 as in the case where metallic casing 40 is a power supply metallic casing of a downlight, in what an orientation metallic casing 40 is installed is unknown. In other words, it is difficult to manage an installation orientation of metallic casing 40. For that reason, in order to ensure a communication performance regardless of the installation orientation of metallic casing 40, it is desired that the wireless communication performed by lighting-up device 100 is omnidirectional. With lighting-up device 100 according to the present embodiment, omnidirectionality is achieved in substantially all directions, as described with reference to FIG. 7A to FIG. 7C.

As described above, according to the present embodiment, it is possible to implement lighting-up device 100 which has an excellent communication performance in wireless communications.

In addition, each of first slit 51 and second slit 52 is provided so as to extend from a portion of side 43 other than both ends of side 43. According to this configuration, it is possible to increase the strength of metallic casing 40 compared to the case where a slit is provided along the edge line (side) of metallic casing 40. For that reason, it is possible to prevent damage or the like to metallic casing 40, making it possible to implement lighting-up device 100 which excels in safety and reliability.

In addition, for example, first portion 44 and second portion 45 are a same portion of side 43, and first slit 51 is continuous with second slit 52 at first portion 44 (i.e., at second portion 45).

According to this configuration, first slit 51 and second slit 52, which are a continuous slit, form a single slit 50, making it easy to secure the length of $\lambda/2$ as the length of slit 50. Accordingly, it is possible to enhance the communication performance of lighting-up device 100.

In addition, for example, each of the extending direction of first slit 51 (first direction) and the extending direction of second slit 52 (second direction) is orthogonal to side 43.

According to this configuration, since first slit 51 and second slit 52 are orthogonal to each other, it is possible to cause both of first slit 51 and second slit 52 to be orthogonal to the excitation direction of antenna 32. Accordingly, it is possible to increase the gain, and enhance the communication performance of lighting-up device 100.

In addition, for example, luminaire 1 according to the present embodiment includes lighting-up device 100 and light source 12.

According to this configuration, since lighting-up device 100 is included, it is possible to implement luminaire 1 having an excellent communication performance in wireless communications.

(Variation)

Next, Variations 1 to 4 of the embodiment will be described.

A lighting-up device and a luminaire according to Variations 1 to 4 differ from the lighting-up device and the luminaire according to the embodiment, in the configuration of metallic casing 40. Accordingly, in the following description, the configuration of a metallic casing of each of the variations will be mainly described, and description of other configurations will be omitted or simplified.

[Variation 1]

Figure 8:
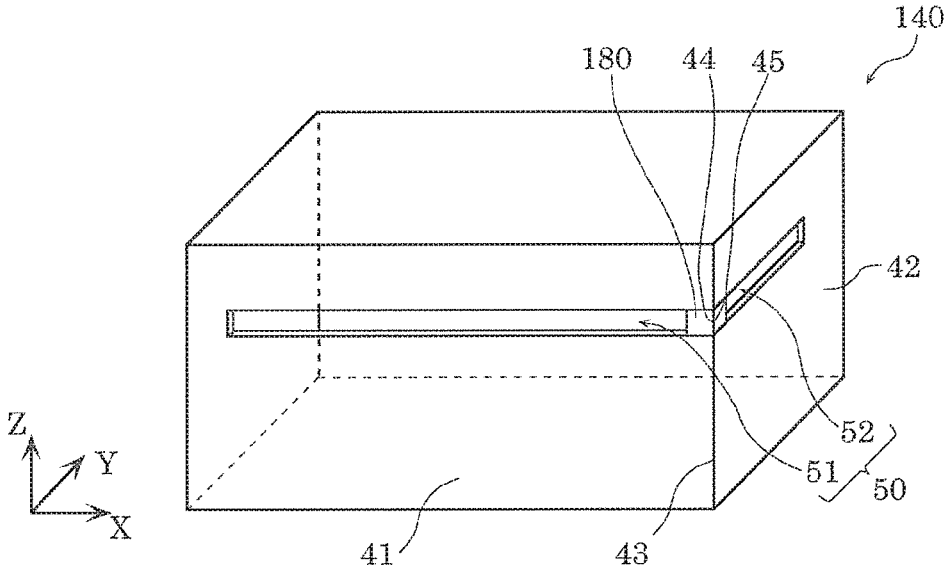
FIG. 8 is a perspective view which illustrates a power supply metallic casing according to Variation 1 of the embodiment.

First, Variation 1 will be described with reference to FIG. 8. FIG. 8 is a perspective view of metallic casing 140 according to a present variation.

Slit 50 which is similar to slit 50 of the embodiment is provided in metallic casing 140 as illustrated in FIG. 8. Slit 50 is provided with insulator 180.

Insulator 180 is a structure which maintains a slit width to a predetermined width, and has electrically an insulation property. Insulator 180 is formed using, for example, an epoxide-based resin material.

According to the present variation, insulator 180 is disposed in both of first slit 51 and second slit 52. More specifically, insulator 180 is disposed at an intersecting portion between first slit 51 and second slit 52; that is, first portion 44 (i.e., second portion 45) on side 43.

It should be noted that insulator 180 may be disposed in either one of first slit 51 and second slit 52. For example, insulator 180 may be disposed at a center portion of first slit 51 or second slit 52, or at an end portion opposite to first portion 44 or second portion 45. In addition, a plurality of insulators 180 may be discretely disposed in either one of first slit 51 and second slit 52. Insulator 180 may be disposed so as to fill the entirety of first slit 51 and second slit 52.

As described above, the lighting-up device according to the present variation further includes insulator 180 which is disposed in at least one of first slit 51 and second slit 52, and maintains a slit width to a predetermined width.

According to this configuration, it is possible to maintain the width of slit 50 to a predetermined width. Accordingly, it is possible to suppress a decrease in the communication performance in wireless communications. In addition, it is possible to suppress deformation of metallic casing 140, and increase the strength of metallic casing 140. In addition, it is possible to suppress ingression of dust and moisture to the inside of metallic casing 140, by physically filling at least a part of slit 50. Accordingly, it is possible to increase the safety and reliability.

In addition, for example, insulator 180 is disposed in at least one of first portion 44 and second portion 45.

According to this configuration, since insulator 180 is disposed on side 43, it is possible to further increase the strength of metallic casing 140.

[Variation 2]

Figure 9:
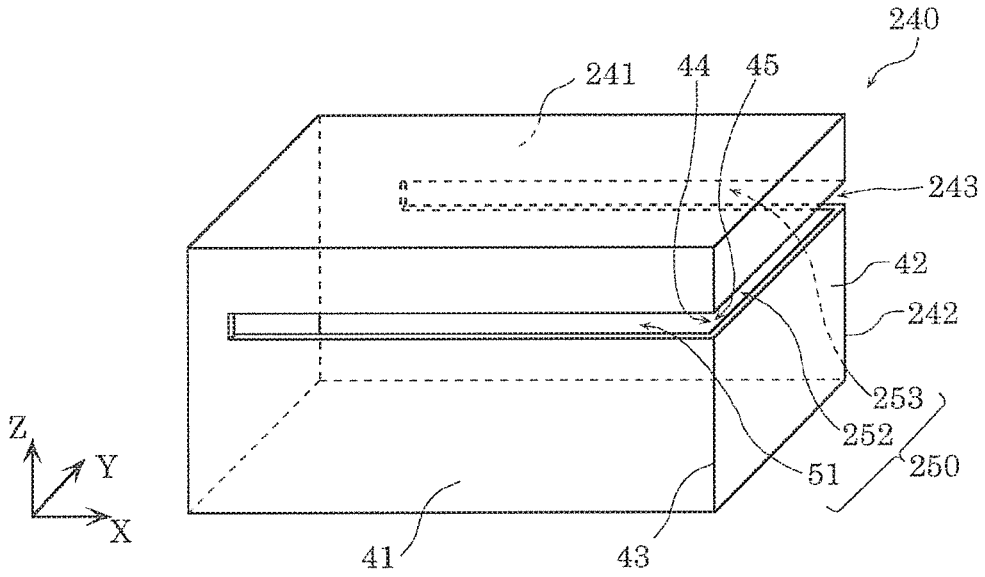
FIG. 9 is a perspective view which illustrates a power supply metallic casing according to Variation 2 of the embodiment.

Next, Variation 2 will be described with reference to FIG. 9. FIG. 9 is a perspective view of metallic casing 240 according to a present variation.

As illustrated in FIG. 9, metallic casing 240 includes side face 241 which shares side 242 with side face 42. Side face 241 and side face 42 are connected by side 242 to form a predetermined angle. For example, side face 241 and side face 42 are substantially vertically connected. According to the present variation, side face 241 is a third side face which extends along a longitudinal direction of metallic casing 240, and disposed opposite to side face 41 to be substantially parallel to side face 41.

Side face 241 is provided with third slit 253 which extends in a third direction from third portion 243 that is a portion of side 242 other than both ends of side 242. Third direction is, for example, a longitudinal direction of metallic casing 240 (i.e., the direction of axis X). In other words, according to the present variation, third slit 253 is substantially parallel to first slit 51. Third slit 253 is an elongated opening (through hole) having a substantially rectangular shape. Third slit 253 does not coincide with an end of side face 241 (i.e., an edge line of metallic casing 240). Side face 241 is present on both sides of third slit 253 in the crosswise direction. It should be noted that the length of third slit 253 is, for example, the same as the length of first slit 51. However, the length of third slit 253 is not limited to this example.

According to the present variation, second slit 252 included in side face 42 extends from second portion 45 to third portion 243. In other words, first slit 51, second slit 252, and third slit 253 are a continuous slit. More specifically, first slit 51 and second slit 252 are orthogonal to each other, second slit 252 and third slit 253 are orthogonal to each other, and first slit 51, second slit 252, and third slit 253 form slit 250 having a substantially U shape in a top view. Slit 250 is electromagnetically coupled to antenna 32 of wireless communication circuit 30 to function as a slot antenna.

As described above, in the lighting-up device according to the present variation, metallic casing 240 further has side face 241 which shares side 242 with side face 42, side face 241 is provided with third slit 253 which extends in a third direction, from third portion 243 of side 242 other than both ends of second side 242, third slit 253 is electromagnetically coupled to antenna 32 and functions as a slot antenna, and second slit 252 extends from second portion 45 to third portion 243, and is continuous with third slit 253 at third portion 243.

According to this configuration, slit 250 is formed to extend over three faces of metallic casing 240, and thus it is possible to cause the total length of slit 250 to be further longer. Accordingly, it is possible to expand a communication band which can be used in wireless communications.

[Variation 3]

Figure 10:
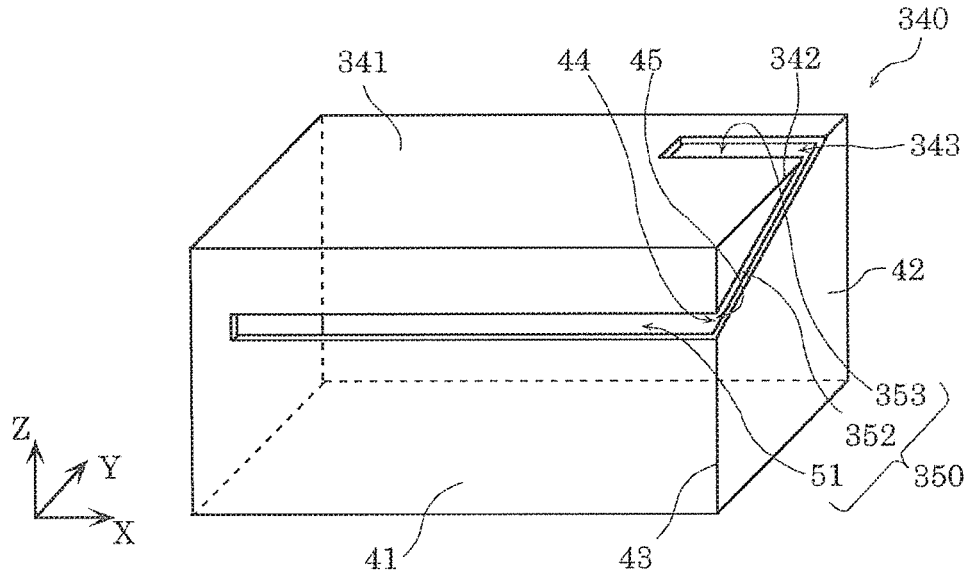
FIG. 10 is a perspective view which illustrates a power supply metallic casing according to Variation 3 of the embodiment.

Next, Variation 3 will be described with reference to FIG. 10. FIG. 10 is a perspective view of metallic casing 340 according to a present variation.

As illustrated in FIG. 10, metallic casing 340 includes side face 341 which shares side 342 with side face 42. Side face 341 and side face 42 are connected by side 342 to form a predetermined angle. For example, side face 341 and side face 42 are substantially vertically connected. According to the present variation, side face 341 is a third side face which extends along the longitudinal direction of metallic casing 340, and disposed substantially perpendicular to side face 41. In other words, side face 341 shares a side also with side face 41.

Side face 341 is provided with third slit 353 which extends in the third direction, from third portion 343 that is a portion of side 342 other than both ends of side 342. Third direction is, for example, a longitudinal direction of metallic casing 340 (i.e., the direction of axis X). In other words, according to the present variation, third slit 353 is substantially parallel to first slit 51. Third slit 353 is an elongated opening (through hole) having a substantially rectangular shape. Third slit 353 does not coincide with an end of side face 341 (i.e., an edge line of metallic casing 340). Side face 341 is present on both sides of third slit 353 in the crosswise direction.

According to the present variation, the extending direction (second direction) of second slit 352 included in side face 42 is not perpendicular to side 43 within side face 42. In other words, the extending direction of second slit 352 is inclined with respect to side 43. Specifically, the second direction is a direction from second portion 45 toward third portion 343.

More specifically, second slit 352 extends from second portion 45 to third portion 343. In other words, first slit 51, second slit 352, and third slit 353 are a continuous slit. More specifically, first slit 51, second slit 352, and third slit 353 are a continuous slit, and form slit 350 which has a substantially U shape. Slit 350 is electromagnetically coupled to antenna 32 of wireless communication circuit 30 to function as a slot antenna.

It should be noted that the extending direction (first direction) of first slit 51 may also be not perpendicular to side 43. The extending direction (third direction) of third slit 353 may also be not perpendicular to side 342. The slits which are provided on the respective faces of metallic casing 340 may extend in any directions.

As described above, in the lighting-up device according to the present variation, for example, at least one of the extending direction of first slit 51 and the extending direction of second slit 352 is not perpendicular to side 43 within side face 42.

According to this configuration, slit 350 is formed to extend over three faces of metallic casing 340, and thus it is possible to cause the total length of slit 350 to be further longer. Accordingly, it is possible to expand a communication band which can be used in wireless communications.

In addition, since a part of slit 350 is inclined with respect to the excitation direction of antenna 32, it is possible to cause a communication range to have a directivity. According to this configuration, it is possible to expand the communication range toward a specific direction.

[Variation 4]

Figure 11:
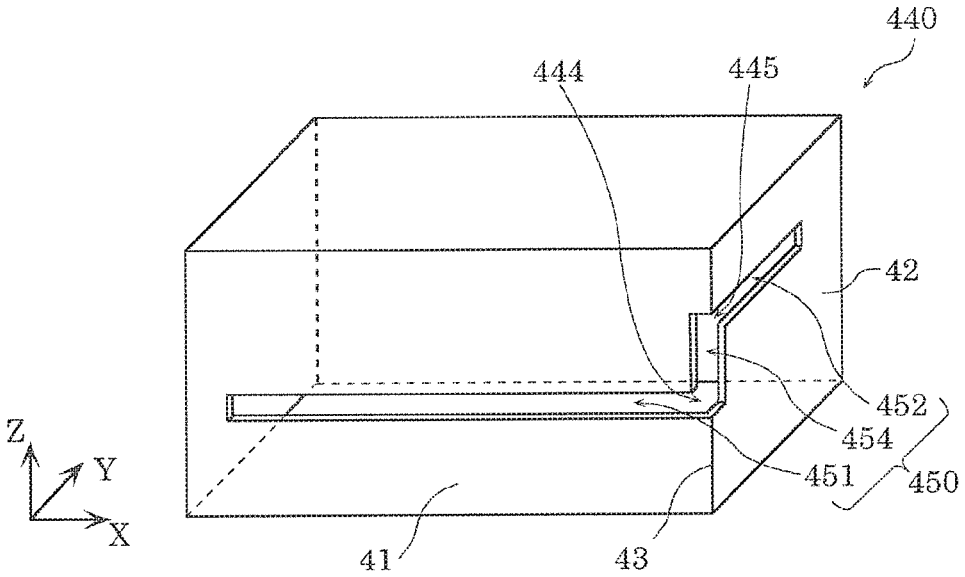
FIG. 11 is a perspective view which illustrates a power supply metallic casing according to Variation 4 of the embodiment.

Next, Variation 4 will be described with reference to FIG. 11. FIG. 11 is a perspective view of metallic casing 440 according to a present variation.

As illustrated in FIG. 11, side face 41 of metallic casing 440 is provided with first slit 451 which extends in the first direction intersecting with side 43, from first portion 444 that is a portion of side 43 other than both ends of side 43. Side face 42 of metallic casing 440 is provided with second slit 452 which extends in the second direction intersecting with side 43, from second portion 445 that is a portion of side 43 other than both ends of side 43. According to the present variation, first portion 444 and second portion 445 are different portions on side 43.

Side 43 is provided with fourth slit 454 extending from first portion 444 to second portion 445. In other words, fourth slit 454 is an edge line slit formed by partially cutting out metallic casing 440 along side 43.

According to the present variation, first slit 451, fourth slit 454, and second slit 452 are a continuous slit, and form slit 450 which has a shape of a polygonal line. Slit 450 is electromagnetically coupled to antenna 32 of wireless communication circuit 30 to function as a slot antenna.

As described above, with the lighting-up device according to the present variation, for example, first portion 444 and second portion 445 are different portions of side 43, side 43 is provided with fourth slit 454 extending from first portion 444 to second portion 445, and fourth slit 454 is electromagnetically coupled to antenna 32 to function as a slot antenna.

According to this configuration, it is possible to cause the total length of slit 450 to be further longer, by using fourth slit 454 provided on side 43. Accordingly, it is possible to expand a communication band which can be used in wireless communications. In addition, since fourth slit 454 is included, it is possible to cause a communication range to have directivity. According to this configuration, it is possible to expand the communication range toward a specific direction.

(Others)

Although the lighting-up device and the luminaire according to the present disclosure have been described based on the above-described embodiment and the variations thereof, the present disclosure is not limited to the above-described embodiment and the variations thereof.

For example, although the case where the excitation direction of antenna 32 is orthogonal to each of the slits has been described in the above-described embodiment, the present disclosure is not limited to this example. For example, each of the slits may be inclined with respect to the excitation direction of antenna 32. The angle of inclination in this case may be, for example, less than or equal to 45 degrees.

In addition, although the case where, for example, each of the slits included in the metallic casing is a slit having a linear shape extending in a predetermined direction has been described in the above-described embodiment, the present disclosure is not limited to this example. Each of the slits may be curved in the face. For example, first slit 51 may be formed into an L shape or a U shape in side face 41. In addition, for example, one side face of the metallic casing may be provided with a plurality of slits.

In addition, although the case where, for example, two side faces of the metallic casing share a side (i.e., an edge line), and are orthogonal to each other, has been described in the above-described embodiment, the present disclosure is not limited to this example. Two side faces may form an acute angle or an obtuse angle. In addition, chamfering such as round chamfering or square chamfering may be applied to the side shared by two side faces.

In addition, although the case where, for example, luminaire 1 is a recessed ceiling downlight has been described in the above-described embodiment, the present disclosure is not limited to this example. For example, luminaire 1 may be installed by being recessed in other construction materials such as a wall material, a floor material, or a pillar material, instead of ceiling member 2 Alternatively, luminaire 1 is not limited to a recessed lighting apparatus, and may be other lighting apparatus such as a spotlight. In addition, a light source may be housed in a metallic casing, and the metallic casing may be a lamp body. For example, luminaire 1 may be a ceiling light, a base light, a desk light, or the like.

It should be noted that the present disclosure also includes other forms in which various modifications apparent to those skilled in the art are applied to the embodiments or forms in which structural components and functions in the embodiments are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting-up device, comprising:

a power supply circuit which supplies power to a light source;

a wireless communication circuit including an antenna that receives a control signal for controlling an operation of the power supply circuit; and a metallic casing which includes metal and houses the power supply circuit and the wireless communication circuit, wherein:

the metallic casing has a first side face and a second side face which share a first side, the first side face is provided with a first slit which extends in a first direction intersecting with the first side, from a first portion of the first side other than both ends of the first side, the second side face is provided with a second slit which extends in a second direction intersecting with the first side, from a second portion of the first side other than the both ends of the first side, and each of the first slit and the second slit is electromagnetically coupled to the antenna and functions as a slot antenna.

2. The lighting-up device according to claim 1, wherein:

the first portion and the second portion are a same portion of the first side, and the first slit is continuous with the second slit at the first portion.

3. The lighting-up device according to claim 1, wherein:

the metallic casing further has a third side face which shares a second side with the second side face, the third side face is provided with a third slit which extends in a third direction, from a third portion of the second side other than both ends of the second side, the third slit is electromagnetically coupled to the antenna and functions as a slot antenna, and the second slit extends from the second portion to the third portion, and is continuous with the third slit at the third portion.

4. The lighting-up device according to claim 3, wherein the first direction and the third direction are parallel to each other.

5. The lighting-up device according to claim 4, wherein the first portion and the second portion are a same portion of the first side, and the first slit is continuous with the second slit at the first portion.

6. The lighting-up device according to claim 5, wherein:

the second side face is perpendicular to each of the first side face and the third side face, the first side face and the third side face are parallel to each other, and the first direction and the second direction are each orthogonal to the first side.

7. The lighting-up device according to claim 5, wherein:

the first side face, the second side face, and the third side face are each perpendicular to one another, and the second direction is not perpendicular to the first side within the second side face.

8. The lighting-up device according to claim 1, wherein at least one of the first direction and the second direction is not perpendicular to the first side.

9. The lighting-up device according to claim 1, wherein the first direction and the second direction are each orthogonal to the first side.

10. The lighting-up device according to claim 1, further comprising:

an insulator which is disposed in at least one of the first slit and the second slit, and maintains a slit width to a predetermined width.

11. The lighting-up device according to claim 10, wherein the insulator is disposed in at least one of the first portion and the second portion.

12. The lighting-up device according to claim 1, wherein:

the first portion and the second portion are different portions of the first side, the first side is provided with a fourth slit which extends from the first portion to the second portion, and the fourth slit is electromagnetically coupled to the antenna and functions as a slot antenna.

13. The lighting-up device according to claim 12, wherein:

the first side face and the second side face are perpendicular to each other, and the first direction and the second direction are each orthogonal to the first side.

14. The lighting-up device according to claim 1, wherein:

the wireless communication circuit includes a board having a main face parallel to the first side face, and the antenna is a pattern antenna disposed on the main face.

15. The lighting-up device according to claim 14, wherein:

the antenna includes:

a radiation conductor which has a length corresponding to a frequency of a wireless communication performed by the wireless communication circuit; and a grounded conductor which is grounded, and the radiation conductor and the grounded conductor are each a part of a metal line disposed on the main face.

16. The lighting-up device according to claim 15, wherein the first slit overlaps with at least a portion of the radiation conductor and the grounded conductor, in a plan view of the main face.

17. The lighting-up device according to claim 16, wherein the first slit overlaps with the grounded conductor in the plan view of the main face.

18. A luminaire, comprising:

the lighting-up device according to claim 1; and the light source.

19. The luminaire according to claim 18, wherein:

the first portion and the second portion are a same portion of the first side, and the first slit is continuous with the second slit at the first portion.

20. The luminaire according to claim 18, wherein:

the metallic casing further has a third side face which shares a second side with the second side face, the third side face is provided with a third slit which extends in a third direction, from a third portion of the second side other than both ends of the second side, the third slit is electromagnetically coupled to the antenna and functions as a slot antenna, and the second slit extends from the second portion to the third portion, and is continuous with the third slit at the third portion.

* * * * *